US008771819B2

(12) United States Patent
Eaton

(10) Patent No.: US 8,771,819 B2
(45) Date of Patent: Jul. 8, 2014

(54) UNIVERSAL TANK OVERLAY

(76) Inventor: Edward J. Eaton, Bay Shore, NY (US)

( * ) Notice: Subject to any disclaimer, the term of this patent is extended or adjusted under 35 U.S.C. 154(b) by 0 days.

(21) Appl. No.: 12/703,755

(22) Filed: Feb. 10, 2010

(65) Prior Publication Data

US 2011/0195205 A1 Aug. 11, 2011

(51) Int. Cl.
*B65D 25/34* (2006.01)

(52) U.S. Cl.
USPC ..... 428/99; 428/900; 150/154

(58) Field of Classification Search
USPC ..... 428/99, 900; 150/154, 901; 220/694.1; 24/303, 614–627, 662–697.1
See application file for complete search history.

(56) References Cited

U.S. PATENT DOCUMENTS

| | | | | |
|---|---|---|---|---|
| 301,211 | A | 7/1884 | Canan | |
| 2,928,565 | A | 3/1960 | Glasoe, Jr. | |
| 3,378,893 | A * | 4/1968 | Labek | 24/303 |
| D243,454 | S | 2/1977 | Kerr et al. | |
| 5,839,237 | A * | 11/1998 | Davidson | 52/3 |
| 5,893,479 | A | 4/1999 | Berberat | |
| 5,933,926 | A * | 8/1999 | Reiter | 24/303 |
| D460,145 | S | 7/2002 | Johnson | |
| D559,942 | S | 1/2008 | Rogers | |
| 7,731,052 | B2 * | 6/2010 | Rappaport | 220/592.24 |
| 2003/0054309 | A1 | 3/2003 | King | |

FOREIGN PATENT DOCUMENTS

CN 200620087684 8/2007

OTHER PUBLICATIONS

Advertisement for tank Mate Custom Oil Tank dated Jun. 24, 2005 from Oil Storage Solutions from http://www.oilstoragesolutions.com/tankmate.htm.

* cited by examiner

*Primary Examiner* — Alexander Thomas
(74) *Attorney, Agent, or Firm* — Harold G. Furlow, Esq.

(57) ABSTRACT

A universal tank overlay is described that can be attached to different sizes and configurations of storage tanks. The overlay comprises a flexible layer of material that includes at least one section. The layer is adapted to connect to a storage tank that includes two opposing end walls that are connected by an at least partially arcuate elongate tubular sidewall. The tank also includes a plurality of pipes that provide for flow into, from and vent the tank. The layer includes at least one aperture that adjusts to receive the plurality of pipes on the tank. The layer has a first position that is separate from the tank and a second position that includes the layer attached to the tank. In the second position the storage tank at least partially covers the tank. The layer is adapted for positioning on the sidewall of the tank. The layer is attached to the tank using fasteners.

20 Claims, 8 Drawing Sheets

UNIVERSAL TANK OVERLAY

BACKGROUND OF THE INVENTION

1. Field of the Invention

This disclosure relates to overlays for objects and in particular to an adjustable overlay for a storage tank.

2. Description of the Related Art

Above ground heating oil storage tanks are often unsightly whether they are located outside or inside of a structure. The tanks are elongate structures that in one example of home heating applications have storage capacity, dimensions and external port configurations that vary greatly between manufacturers and models of a single manufacturer. For example, one manufacturer sells home oil storage tanks that include 138, 220, 240, 275 and 330 gallon horizontal tanks. The dimensions of the horizontally aligned tanks vary in height between 22 to 44 inches, width between 23 to 47 inches and length between 30 to 72 inches.

One common home oil tank is the 275 gallon home oil above ground steel tank. The 275 gallon tanks from one manufacturer have an approximately cylindrical shape with an elongate sidewall that includes a rounded top and a rounded bottom. The sidewalls have a circular or oval cross-sectional shape perpendicular to a longitudinal axis of the tank. The sidewall can vary in height between 27 to 44 inches, width between 27 to 44 inches and has a length of approximately 60 inches. While these dimensions are "standard" for one manufacturer, in practice the "standard" sidewall dimensional length has commonly varied between approximately 58-61 inches. The tank sidewalls connect to end walls that have a circular or oval shape and are approximately perpendicular to the longitudinal axis of the tank. The end walls can be flat or convex. The standoffs that support the tank typically provide another approximately 12 inches of height above the mounting surface.

Oil tanks require ports for input flow, output flow, servicing and expansion. The placement or configuration of these ports also varies between models and manufacturers. For example, some input or fill ports are positioned on the top of the tank and others are on the sides. Tanks typically gravity feed from an outlet in proximity to the bottom of the tank, but this too can vary between the sides and bottom.

The common feature of storage tanks is that they are utilitarian structures that lack ornamentation and are widely recognized as being unsightly. In particular, as these steel tanks age, they rust and discolor further detracting from their appearance. Even with improved materials and coatings, oil tanks having a detracting appearance from residential and commercial structures.

The current systems for improving the appearance of oil tanks are box like structures that enclose the oil tank within a larger footprint. These structures are typically fabricated from polymers and have the appearance of a small low shed. These structures are limited in their ability to accommodate the varying configurations of pipes that extend from the tanks, accommodate tight fitting installations in which the tank is positioned in close proximity to an exterior wall of the home and tanks positioned on sloping ground. These structures also limit access to the tank and can provide an undesirable obstruction to access the tank for routine filling or maintenance.

An enclosure for a storage oil tank is needed that has the ability to adjust to varying tank dimensions, different port configurations and the position of the tank relative to external structures while providing a decorative aspect to the enclosure.

SUMMARY OF THE INVENTION

A universal tank overlay is described that is adapted for use with a storage tank. The overlay comprises a flexible layer of material that includes at least one section. The layer includes a first edge, a second edge opposed to the first edge, a third edge and a fourth edge opposed to the third edge. The third edge and fourth edge connect to the first edge and second edge. The tank includes two opposing end walls that are connected by an at least partially arcuate elongate tubular sidewall. A first section of the layer is adapted to position on the sidewall of the tank.

The layer has a first position in which the layer is separate from the tank. The layer in the first position includes at least one fastener that attaches the layer to the tank. The layer defines at least one aperture. In a second position of the layer, the layer is positioned at least partially on the sidewall of the tank and the at least one aperture of the layer receives the plurality of pipes. The plurality of pipes extend through the at least one aperture. The at least one fastener fixes the position of the layer relative to the tank and the at least one fastener places the layer positioned on the sidewall in tension.

The layer can include ornamental features such as a decorative element that can be an advertisement, promote a product, or a decorative enhancement to the cover, for example. The at least one aperture of layer can be opened and closed by removable and replaceable access panels. The at least one fastener can connect to an inwardly directed surface of the layer on one side and connect to the tank on the opposing side. The at least one fastener can also include fasteners that connect to the layer and further include magnets that are adapted to connect to the tank. The set of fasteners can further include a retention mechanism. The at least one fasteners can include a snap socket, a snap cap and a snap stud. The snap socket and snap cap attach to the layer and the snap cap attaches to a snap stud that can further include a magnet. The magnet is adapted to connect to the tank. The tank end walls and sidewall are typically made of ferrous metals and at least one fastener can include a magnet that attaches the layer to the tank using magnetic forces. The at least one fastener can also connect two or more sections of the layer together.

The second position of the layer can also include the layer positioned on the sidewall and two of the opposed edges of the layer extending at least partially over the end walls of the tank. The at least one fastener includes a retention mechanism connects in proximity to the two opposed edges of the layer that extend at least partially over the end wall and attach the layer to the tank over the end walls. The retention mechanism also places at least a portion of the layer positioned on the tank in tension.

The at least one fastener includes a retention mechanism and in the second position the retention mechanism secures two opposed edges of the layer at least partially around the sidewall of the tank. The retention mechanism places at least a portion of the layer positioned on the tank in tension. The retention mechanism can include a bias in proximity to two of the opposed edges of the layer and the bias of the two opposed edges attaches the layer to the tank in the second position.

A universal tank overlay is also described that is adapted for use with a storage tank that comprises a flexible layer of material that includes at least one section. A plurality of pipes connects to and extends from the storage tank. The layer is adapted to connect to the storage tank. The layer is adapted to adjust to the position of the tank relative to an external structure and at least partially cover the tank.

A first section of the layer is adapted for positioning on the sidewall of the tank. The at least one aperture is defined in the layer. The at least one aperture is adapted to receive at least one of the plurality of pipes of the tank. The fasteners that connect to the layer also attach the layer to the tank. The fasteners are connected to the layer in proximity to at least two of the four opposed edges of the layer. The fasteners are adapted to attach to the tank and place at least a portion of the layer positioned on the sidewall in tension.

The fasteners can include a magnet that is adapted to connect to the tank, the sidewall and end walls include ferrous metal. In the second position the fasteners include a retention mechanism in proximity to at least two of the opposed edges of the layer and the retention mechanism places the layer on the sidewall under tension. The set of fasteners includes a retention mechanism that includes a bias element. The fasteners include a snap cap, a snap socket and a snap stud. The snap cap and snap socket connect to the layer. The snap socket connects to the snap stud and the snap stud connects to a magnet that uses magnetism to attach the layer to the tank.

A method of using a universal tank overlay on a storage tank is described that comprises the steps of providing a flexible and adjustable layer of material and a storage tank. The layer includes at least one section. The layer defines at least one aperture. The tank includes an elongate tubular sidewall that is connected to two end walls. A plurality of pipes connects to the tank and extends out from the tank.

The method includes the step of adjusting the layer for positioning on the storage tank. The adjusting includes aligning the at least one aperture of the layer with the plurality of pipes extending from the storage tank. The at least one section of the layer is optionally adjustable to accommodate the storage tank in close proximity to an external structure. The method also includes the step of positioning the layer on the tank. When the layer is positioned on the tank, the at least one aperture receives the plurality of pipes. The step of attaching the layer to the tank includes using at least one fastener to attach the layer to the tank. The attaching can include placing the layer positioned on the tank in tension and fixing the position of the layer relative to the tank using the at least one fastener.

The step of positioning the layer can further include adjusting the position of the layer on the tank for displaying a decorative element. The step of attaching the layer can further include positioning the at least one fastener connected to the layer at select locations on the tank to place at least a portion of the layer on the tank in tension. The step of attaching the layer can also further include using a retention mechanism to attach at least a portion of the layer over the end walls of the tank. The step of attaching the layer can include the at least one fastener including magnets. This includes connecting the at least one fastener to the layer and attaching the layer to the tank using the magnets of the fasteners. The magnetic fasteners are used with tanks fabricated of ferrous metal. The step of attaching the layer further includes using a retention mechanism to attach at least a portion of the layer to the tank. The retention mechanism includes a bias element that is connected to the layer in proximity to two of the opposed edges. The bias elements attach the layer to the tank. The step of attaching the layer can also include the at least one fastener being a heating apparatus and the layer being fabricated of materials that shrink upon the application of heat. The attaching of the layer includes applying the at least one fastener to shrink the layer and attach the layer to the tank.

DETAILED DESCRIPTION OF THE DISCLOSURE

Figure 1:
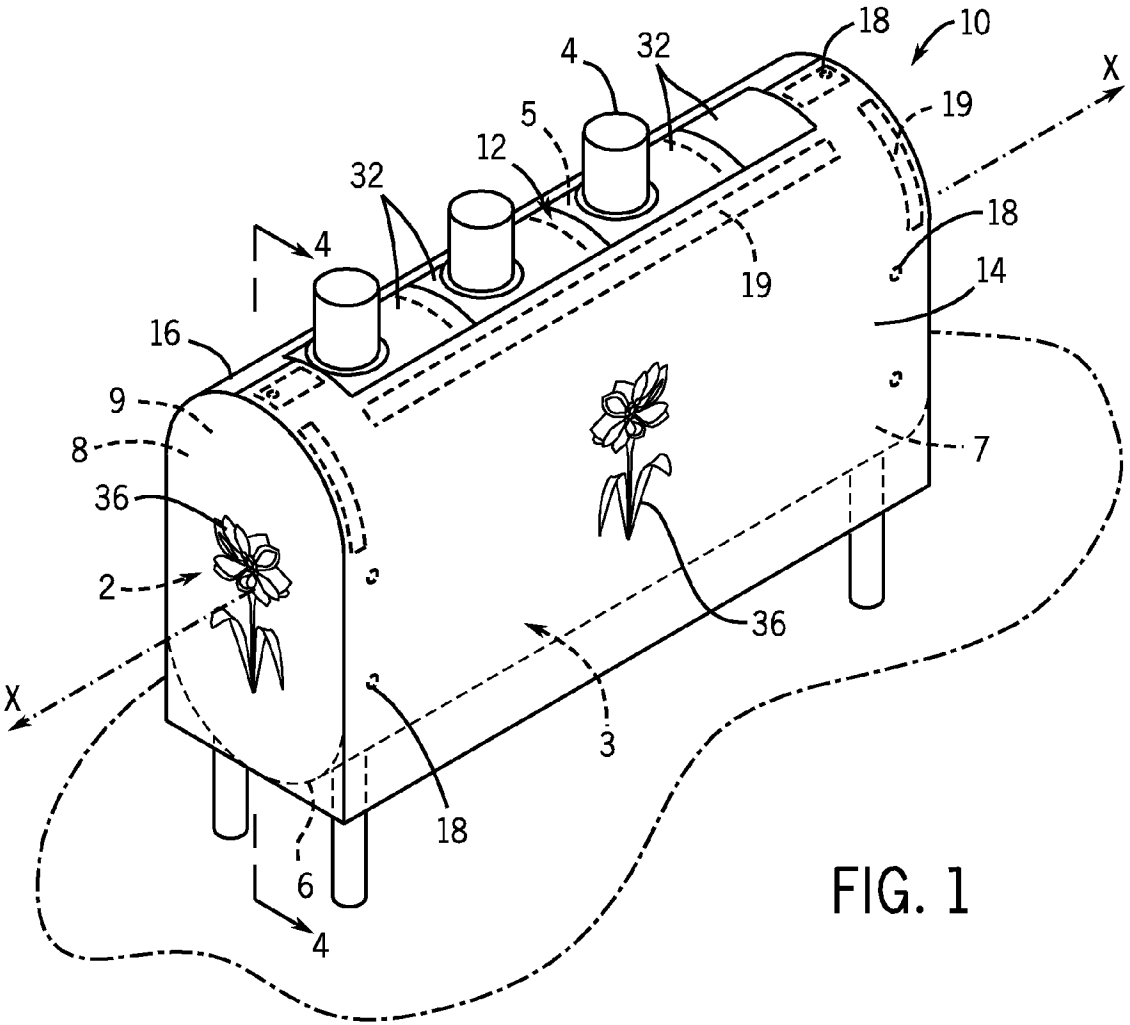
FIG. 1 is a top, front and side perspective view of one preferred embodiment of the apparatus for a universal tank overlay constructed in accordance with the present disclosure, the universal tank overlay is shown connected to an exemplary home oil storage tank.

Referring initially to FIG. 1, a universal tank overlay 10 is shown connected to an exemplary home oil heating tank 2. Universal tank overlay or cover 10 is a single piece or multiple section overlay that can include a first section 12, a second section 14 and a third section 16. Tank cover 10 is connected to tank 2 using fasteners 18.

Tank 2 is an exemplary storage vessel that has an arcuate tubular elongate shape with a longitudinal axis-X that extends along the centerline of tank 2 and parallel with a sidewall 3 of tank 2. A plurality of pipes 4 connects to and extends from tank 2. Sidewall 3 includes an arcuate shaped top portion 5 and an opposed arcuate shaped bottom portion 6 that are connected by an approximately planar front portion 7 and an opposed approximately planar back portion 8. Sidewall 3 terminates in opposing edges that connect to end walls 9. Tank 2 is an enclosure that can be selectively manufactured as a structure for the retention of fluids that can include for example, oil or natural gas.

The specific shape and dimensions of tank 2 can vary depending upon the manufacturer and even by models of a single manufacturer. Tank 2 is made of steel and has a cylindrical or oval cross-section perpendicular to the longitudinal axis-X. Pipes 4 are located at various positions on tank 2 for functions that can include fluid input, fluid outflow, inspection and venting. It is common that one or more of pipes 4 are located on top portion 5 and bottom portion 6 of sidewall 3, but pipes 4 can have locations such as terminal end walls 9. This exemplary tank 2 has four posts that support and position tank 2 relative to an external supporting surface. Tanks 2 are typically positioned with the elongate axis-X approximately horizontal, but can also have alternative positions.

Universal tank overlay 10 is preferably a vinyl impermeable sheet, but it is understood that the material composition of cover 10 can vary depending upon its intended application. For example, cover 10 can have multiple layers of material for both decorative and functional purposes. The materials of construction of cover 10 are selected to provide a reliable and long lasting flexible cover for indoor or outdoor use. Similarly, while cover 10 is a decorative cover, the materials of cover 10 can include apertures for functions that include, but are not limited to enhancing the flow of air or drainage of water between cover 10 and tank 2.

Figure 2:
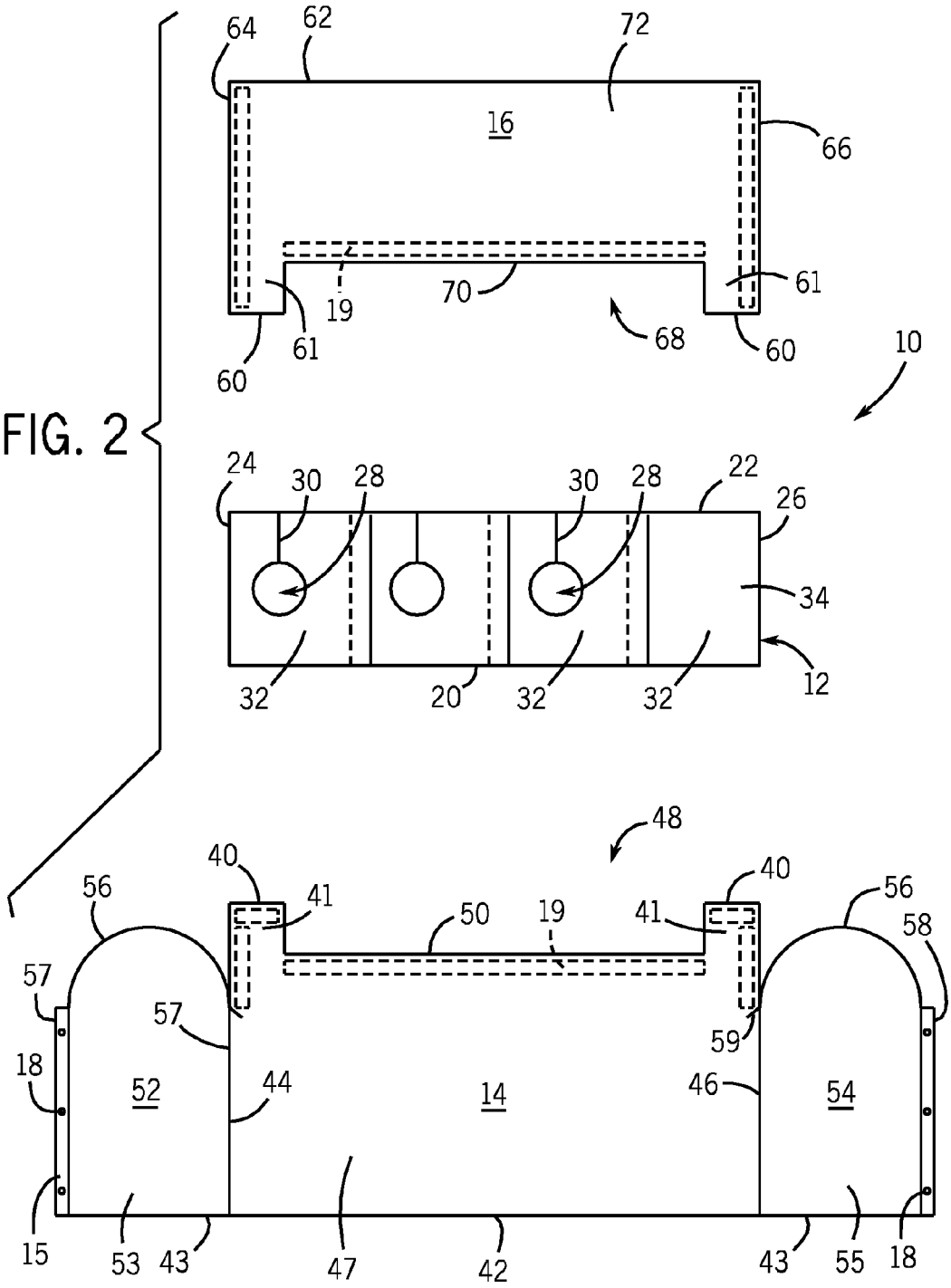
FIG. 2 is a plan view of the universal tank overlay of FIG. 1.

As shown in FIGS. 1 and 2, first section 12 of cover or layer 10 includes a first elongate edge 20 that is opposed to a second elongate edge 22, a third edge 24 is opposed to a fourth edge 26. First section 12 includes one or more apertures 28. Optional lines 30 mark a line that can be a series of preformed structural weaknesses, for example, that aid in subdividing first section 12. In this preferred embodiment of cover 10, section 12 includes one or more panels 32 that can be provided as a separable assembly of section 12 or individual panels 32. Each panel 32 can selectively include an aperture 28 and/or line 30 that can be utilized to define an aperture. As shown, panels 32 are positioned along the approximate centerline of the top portion 5 of sidewall 3, but alternative locations of panels 32 on layer 10 can accommodate alternative locations of pipes 4 on tank 2.

Each panel 32 includes preformed weaknesses, perforations and/or markings such that panels 32 can be removable and replaceable components of first section 12. The perimeter of each edge and aperture 28 defined in first section 12 is preferably constructed to be resistant from ripping or tearing using known methods such as for example reinforcing and/or stiffening the area in proximity to the perimeter using additional layers or stitching for example. First section 12 has an outwardly directed surface 34 and an inwardly directed surface (not shown).

In this one preferred embodiment, panels 32 are approximately six (6) inches wide and lengths that can vary between approximately twelve (12) and approximately twenty-four (24) inches long. The varying lengths accommodate the different sizes of gaps between pipes 4. As stated previously, panels 32 can be fabricated with or without apertures 28 and/or line 30.

Second section 14 includes an exemplary decoration 36 that can be further included on any section of cover 10. Decoration or decorative element 36 can be used, for example, to blend in with, accent or heighten the color and/or texture of an adjoining structure. Alternatively decoration 36 can have pleasant ornamental designs that make a personal statement, provide seasonal displays, as well as promote athletic teams, products or services. In this regard, as one example, decoration 36 turns a home oil storage tank 2 from a common eyesore to an attractive enhancing feature.

Second section 14 has a first elongate edge 40, an opposed second elongate edge 42, a third edge 44 and a fourth edge 46 that is opposed to third edge 44. First edge 40 includes a pair of tabs 41 adjacent edges 44 and 46 that define a central inset or notch 48 with a recessed edge 50 between tabs 41. Second section 14 has an outwardly directed surface 47 and an inwardly directed surface (not shown).

Fastener 18 connects sections 12, 14 and 16 together and/or connects sections 12, 14 and 16 to tank 2. Fasteners 18 preferably include the use of a combination of magnetic fasteners 18 and mechanical, heat or chemical bonding using common techniques such as, for example, hook and loop devices, heat and/or adhesives.

A first panel 52 of second section 14 is connected to edge 44 and a second panel 54 is connected to edge 46. Panels 52 and 54 extend over and cover the opposing terminals ends 9 of tank 2. Panel 52 has an arcuate first edge 56 and an outwardly directed surface 53. A second edge 57 of panel 52 opposes edge 44. Panel 54 has an outwardly directed surface 55 and a similarly shaped arcuate first edge 56. A second edge 58 of panel 54 opposes edge 46. The arcuate first or upper edges 56 preferably have a semi-circular shape. Second edge 42 is extended by second edges 43 of first panel 52 and second panel 54.

Panels 52 and 54 preferably include flaps 15 that are lateral extensions with one or more fasteners 18. Flaps 15 are extensions that extend around the terminal ends 9 and onto the back section 8 of sidewall 3. Flap 15 includes fasteners 18 that connect to back section 8 and assist in the retention of panels 52 and 54 in position on end walls 9.

Cover 10 provides a smooth visually appealing surface on tank 2 independent of the number of pipes 4, dimensional variations of tank 2 and proximity of tank 2 to an external structure. In this regard, additional features can be included in cover 10 that facilitate the smooth appealing appearance of cover 10 on tank 2. These features can include slots 59 in proximity to the upper junction between panels 52 and 54 with edges 44 and 46, respectively. In addition, as required cover 10 in proximity to edges 50 and/or 70 can be structurally enhanced to prevent drooping through methods such as multiple layers of material, elements of layer 10 similar to tabs 41 that extend across aperture 28 and/or additional fasteners 18 and supporting inserts such as a supporting bar.

Third section 16 has a first elongate edge 60, an opposed second elongate edge 62, a third edge 64 and a fourth edge 66 that is opposed to third edge 64. First edge 60 includes a pair of tabs 61 adjacent edges 64 and 66 that define a central inset or notch 68 with a recessed edge 70 between tabs 61. Second edge 62 extends between edges 64 and 66. Third section 16 has an outwardly directed surface 72 and an inwardly directed surface (not shown).

It is understood that while first section 12, second section 14 and third section 16 are shown as separate sections they can also be connected together in any manner into one or more combined sections such as, for example, monolithically formed as a single sheet or connected by seams, adhesives, heat bonding, mechanical fasteners, etc. For example, sections 12, 14 and 16 can be connected such that cover 10 has a first edge 42, a second opposed edge 62 or 22, edge 44 and opposing edge 46 as one of many combinations. Other combinations include the connecting of panels 52 and 54 to edges 24, 44 and 26, 46, respectively such that edge 42 of second section 14 and edge 62 of third section 16 to define a continuous partial enclosure over tank 2.

Figure 3:
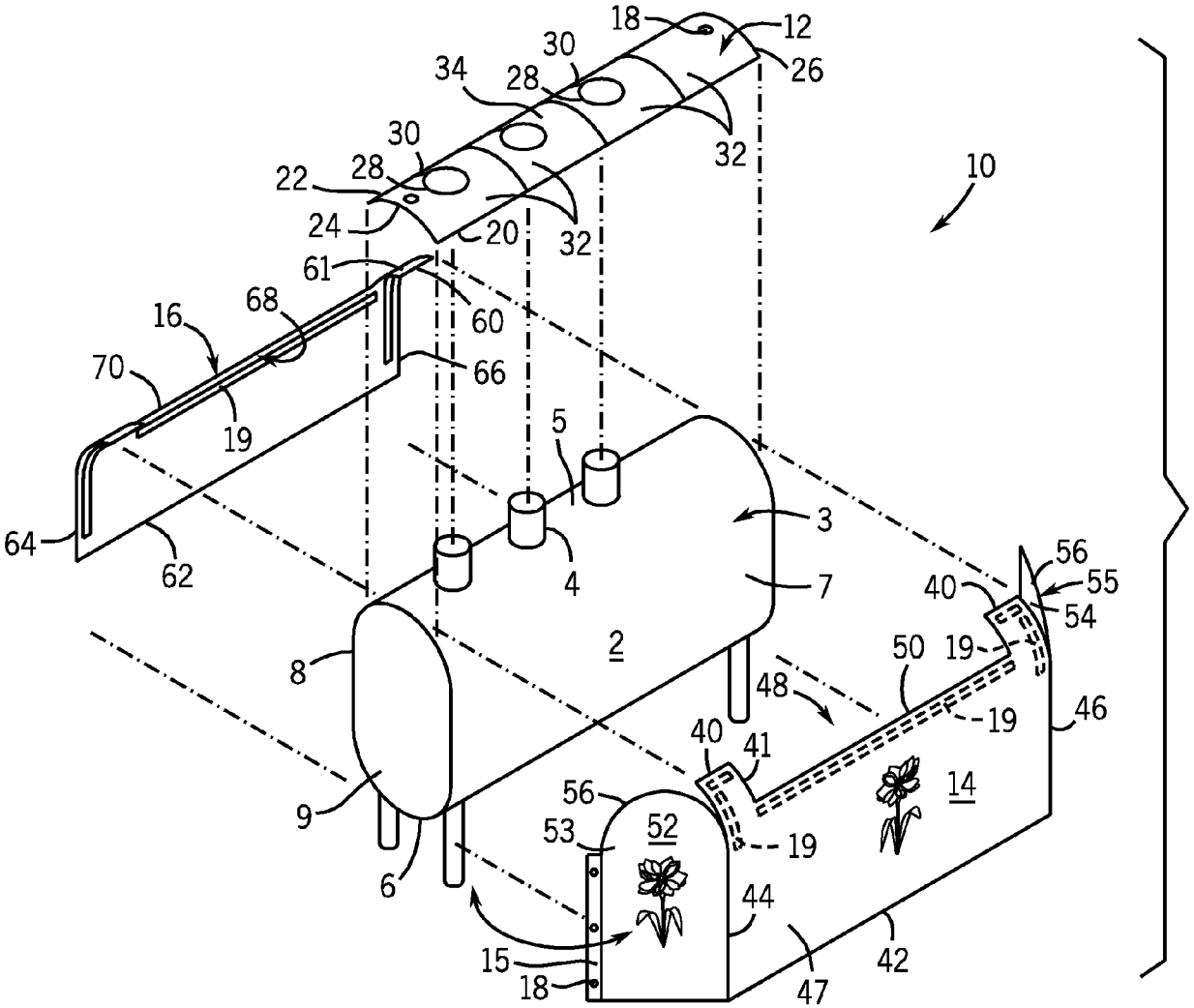
FIG. 3 is a perspective view of the universal tank overlay of FIG. 1 that shows one method of connecting the universal tank overlay to the exemplary tank using a set of fasteners.

Referring now to FIGS. 2 and 3, a method for installing cover 10 includes adjusting first section 12 to accommodate the pipes 4 of oil tank 2 and, as required, the proximity of tank 2 to an external structure. First section 12 is preferably initially positioned on tank 2 followed by second section 14 and/or third section 16.

The adjusting of first section 12 to accommodate pipes 4 includes the adjusting of one or more of panels 32 to accommodate the size and types of pipes 4 tank 2. As required, panels 32 are separated along lines 30 to subdivide panels 32, create apertures 28, enlarge apertures 28 and/or provide access to apertures 28 from of the adjacent edges of panels 32 for pipes 4.

Lines 30 provide the option of accommodating pipes 4 with large diameter lips and/or an external connection by providing the ability to expand the opening of aperture 28 to the edge of panel 32 to accommodate the increased diameter of pipe 4 and/or its external connection. After positioning panel 32 around pipe 4, the opposing separated sides of line 30 of panel 32 can be attached as required using one or more of an overlaying flap, patch, adhesives, tape, hooks and loop type fasteners or just stretching panel 32 across the gap of the slot. Panels 32 with or without apertures 28 can also be employed to cover portions of the top 5 of tank 2 that do not have pipes 4. Smaller pipes 4 and pipes 4 without external connections can often be accommodated by aperture 28 of panels 32 without additional separations along line 30 that extends to the adjacent edge.

Individual panels 32 can attach together to form first section 12. The attachment between panels 32 can be an edge to edge connection, but is preferably an overlapping attachment. Panels 32 can also include fasteners 18 that connect directly to tank 2 and/or connect panels 32 together. Second section 14 and third section 16 are preferably laid over and at least partially across outer surface 34 of panels 32 and can further assist in retaining panels 32 on tank 2.

In this preferred embodiment, tabs 41 and 61 are approximately opposing and aligned, positioned to overlap panels 32 and/or tank 2 and connect together using fasteners 18. Tabs 41 and edge 50 in cooperation with tabs 61 and edge 70 overlay panels 32 and define aperture 28 for pipes 4 with a perimeter defined by notches 50 and 70, respectively.

Cover 10 can also be adjusted to accommodate the position of tank 2 relative to an external surface such as a wall of an adjoining structure. Most often sidewall back section 8 and/or terminal end 9 are in close proximity to an external wall. To accommodate an inaccessible back section 8, third section 16 can be cut and/or folded under and attached to the underside of section 16 so as to further reduce the dimensions between edges 70 and 62. Alternatively, first section 12 and second section 14 can connect together omitting section 16. Similarly, when one or both of terminal ends 9 of tank 2 are close proximity to an external structure, panels 52 and/or 54 can be folded under second section 14 or separated at edges 44 and/or 46.

Once first section 12 is adjusted and trimmed, as necessary, second section 12 is positioned and fixed across top 5 and around terminal ends 9 of tank 2. In one example, first section 12 preferably has a length of approximately 70 inches such that section 12 defines a flap or lip of approximately five (5) inches that extends beyond the end walls 9 that more than encompasses the approximately 58 to 61 inch length common to many of tanks 2. The flaps can be folded under or over panels 52 and 54 and attached to tank 2 and/or panels 52 and 54 using fasteners 18.

Figure 4:
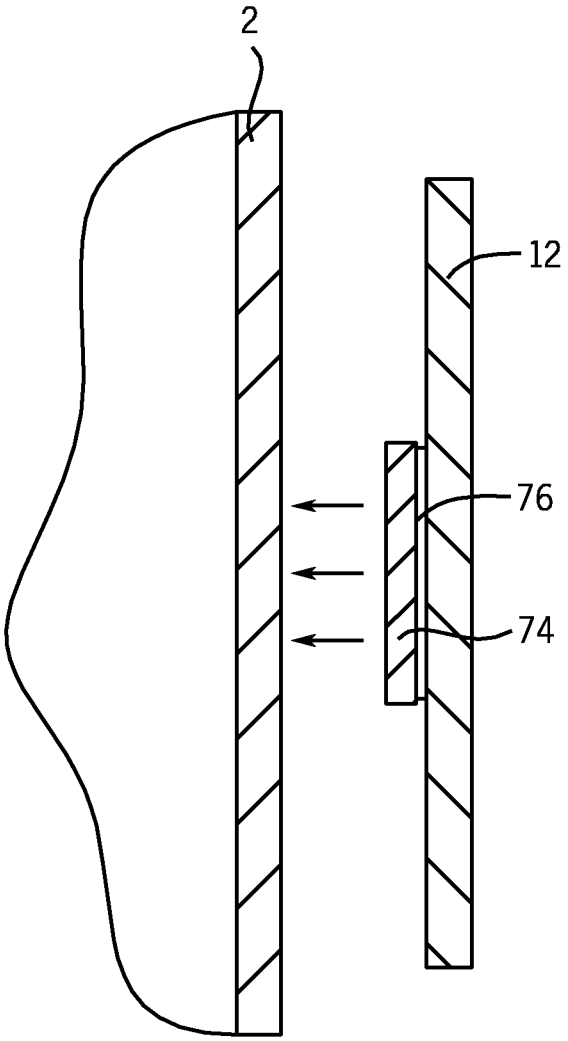
FIG. 4 is a cross-sectional view of one of the fasteners of the set of fasteners taken along lines 4-4 of FIG. 1.

As shown in FIGS. 1, 3 and 4, the preferred method of fixing cover 10 to tank 2 includes the use of fasteners 18 that include a combination of devices that can include magnets 74. In addition, fasteners 18, as defined herein include the joints between different section of cover 10 that can also include fasteners such as a snap fastener, for example, as well as adhesives.

The operational use of magnetic fasteners 18 includes connecting magnets 74 to select locations on cover 10 that align with preferred locations on tank 2. The magnets can be attached to cover 10 using an adhesive, such as Scotch Tape 9465 or as a part of fasteners 18.

Magnets 74 are preferably diamagnetic neodymium high strength magnets rated at 25 pounds of sheer. In the preferred embodiment, cover 10 includes a plurality of magnets 74 in shapes such as discs, plates or bars that are spaced at predetermined intervals so as to interface with cover 10 in proximity to edges 44, 46, 64 and 66. Magnets 74 can be integrally connected to cover 10 at predetermined positions or alternatively, magnets 74 can be connected directly to cover 10 by the user with an adhesive or mechanical fastening devices such as tape, adhesives or hook and loop devices. In one preferred embodiment, VHB double sided is used to adhere magnets 74 to cover 10 because of the long term bonding qualities of the tape under exterior weather conditions. Alternatively, cover 10 can define receptacles that receive and retain magnets 74 at desired specific locations using known means such as adhesives and/or mechanical fastening devices. As a further example, it is understood that the receptacles can be located at predetermined positions for one or more tanks 2 so as to encompass a broad range of dimensional variations of tank 2.

One preferred adhesive for connecting sections of cover 10 together as well as magnets to cover 10 is Scotch® Tape 9465 that is compatible with vinyl material, outside temperature ranges and capable of making an at least water resistant connection. The VHB double sided tape can also be employed. Mechanical fasteners 18, such as snaps provide also provide a secure long term connection between sections. Fasteners 18 can also combine connecting sections together with connecting to tank 2 using magnets 74.

With first section 12 preferably positioned first on top portion 5 of sidewall 3, second section 14 and third section 16 are then positioned over first section 12 and connected together. Flaps 15 of panels 52 and 54 extend around the terminal end walls 9 of tank 2 and onto to the back portion 8 of sidewall 3. Fasteners 18 on flaps 15 connect panels 52 and 54 onto the back portion 8 such that panels 52 and 54 are supported in proximity to fasteners 18 and by the connection to edges 44 and 46, respectively. In addition, the positioning of fasteners 18 on back portion 8 functions to place second section 14 in tension across at least the front 7 of sidewall 3. Further, edges 56 of panels 52 and 54 are constructed to extend onto and over a portion of tank 2 that is at least in proximity to the terminal end wall 9 of tank 2. A bond or joint 19 is then made in proximity to edge 20 of panels 32 and second section 14 and in proximity to edge 22 of panels 32 and third section 16 using fasteners 18.

First section 12 also has an overlapping bond 19 with panels 52 and 54. Bond 19 is preferably an extended connection that can use, for example, a series of mechanical fasteners 18, a heat bond and/or an adhesive that secures an approximately continuous connection between the sections of cover 10. The approximately continuous connections of fasteners 18 and/or bonds 19 aid cover 10 in providing a taught connection on sidewall 3 between end walls 9. The taught connection of cover 10 to tank 2 produces a smooth appearance on at least on front portion 7 of tank 2 that greatly enhances the visual appeal of cover 10.

Figure 5:
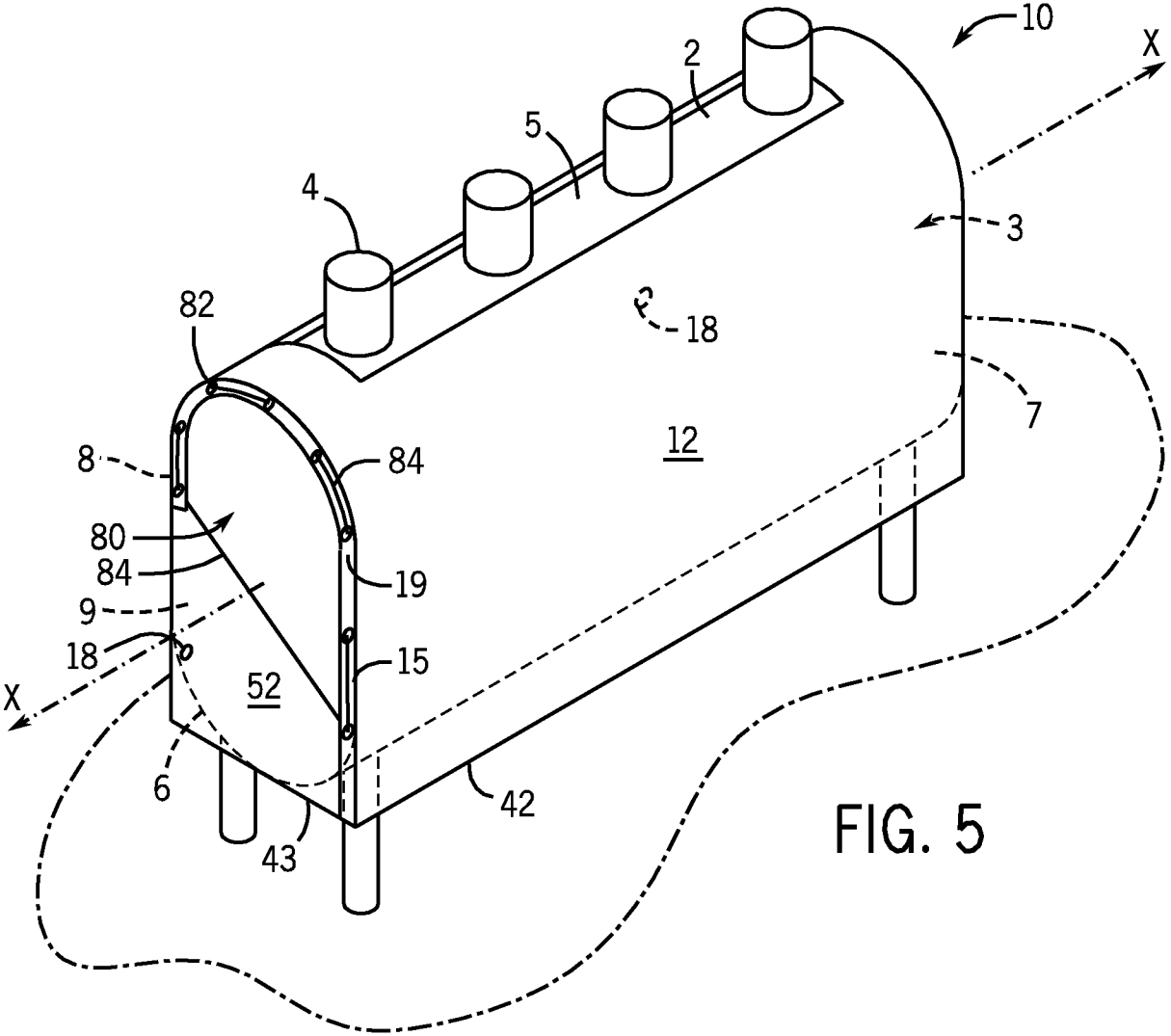
FIG. 5 is a top, front and side perspective view of a second embodiment of the universal tank overlay of FIG. 1 constructed in accordance with the present disclosure, the universal tank overlay is shown connected to an exemplary home oil storage tank.

As shown in FIG. 5 tank 2 is a similar exemplary storage tank as described previously with sidewall 3 aligned the longitudinal axis-X and opposed end walls 9, but in this instance there is an additional pipe 4. It is understood that the number and location of pipes 4 can vary from tank 2 to tank 2. In a second embodiment of cover 10, first section 12 extends across front portion 7, over top portion 5 and at least partially onto the back portion 8 of sidewall 3. Panels 52 and 54 are preferably separate from section 12 in this embodiment and can also be separate optional sections of cover 10.

First section 12 is retained on tank 2 using fasteners 18. Panels 52 and 54 are preferably separate and positioned individually on end walls 9 of tank 2. Fasteners 18 in this embodiment also include a retention mechanism 80. A plurality of fasteners 18 are positioned in proximity to edges 57 and 56 of panel 52 as well as edges 58 and 56 of panel 54 to connect panels 52 and 54 to tank 2 and/or first section 12. Fasteners 18 connect sections of cover 10 together and can further assist in the creating and retaining of tension across portions of cover 10. The creating and retaining of tension on portions of cover 10 provides an improved surface for the displaying of decorative elements 36 (see FIG. 1) that can be included on one or more of the sections of cover 10.

Retention mechanism 80 facilitates the taught retention of cover 10 on tank 2. In this exemplary embodiment, retention mechanism 80 facilitates the taught retention of first section 12 on tank 2 independent of end panels 52 and 54 which are preferably separately positioned and connected to tank 2 from first section 12. It is understood that end panels 52 and/or 54 are optional and can be selectively employed in this embodiment depending upon factors such as the preference of the user and physical limitations such as the position of tank 2 relative to an external structure which can inhibit or prevent the use of one of panels 52 and/or 54.

Figure 6:
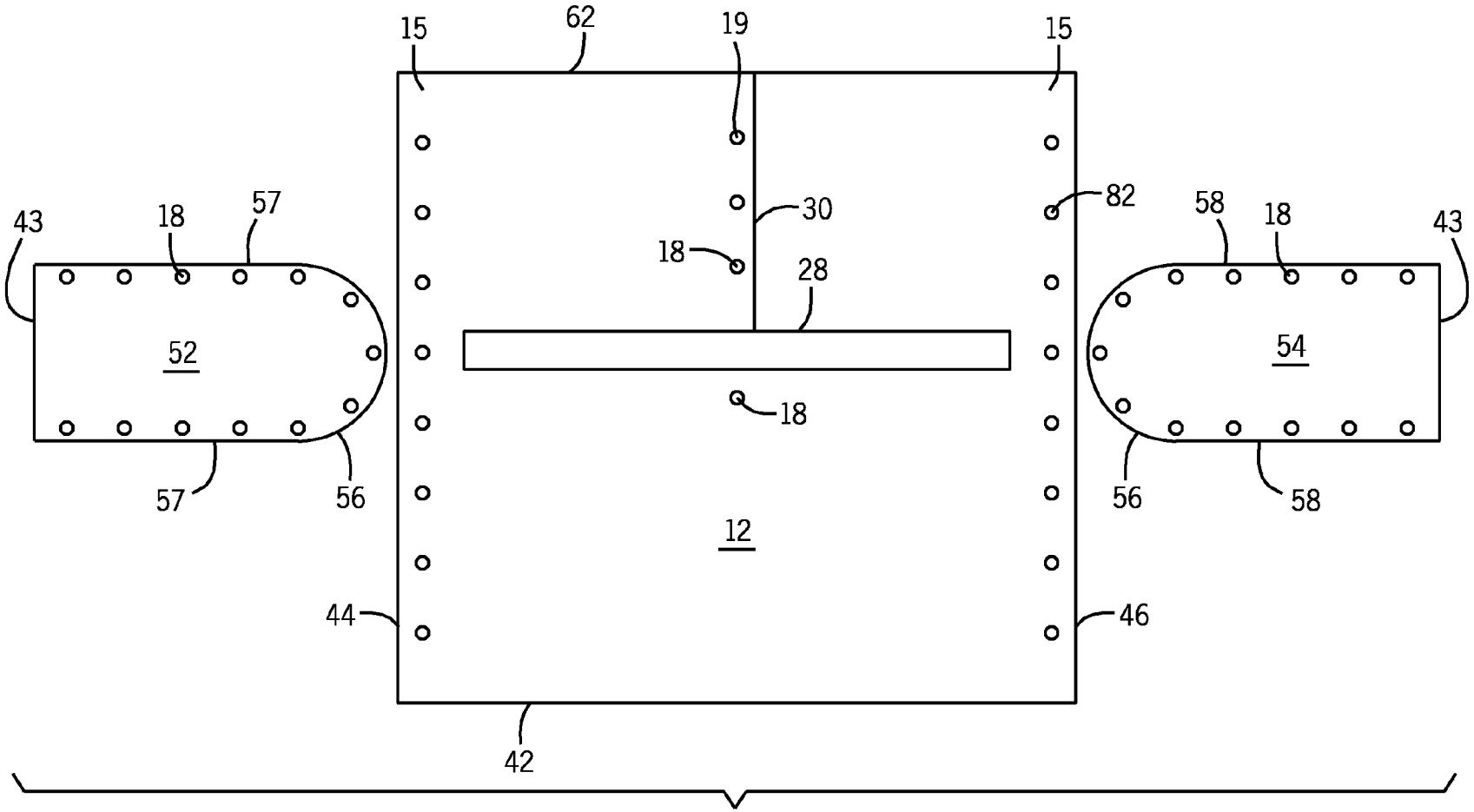
FIG. 6 is a plan view of the universal tank overlay of FIG. 5.

Referring now to FIGS. 5 and 6, first section 12 includes at least one aperture 28 that extends between shoulder portions, similar to tabs 41 and 61 (see FIG. 2) in proximity to third edge 44 and opposed fourth edge 46. At least one aperture 28 is preferably a continuous slot that extends between the shoulder portions or tabs 41, 61, but aperture 28 can be a plurality of apertures interspaced by intermediate connecting tab 41, 61 like portions. A line 30 extends between second edge 62 and at least one aperture 28 that can be selectively made into a slot as described above. As required, once the slot is cut, beside providing access to one or more pipes 4 with an external interface, cover 10 can also be drawn together to overlap the slot cut on line 30 on the back portion of first section 12 in order to facilitate the drawing of tension on cover 10. The overlap of the different portions of first section 12 can be held together by fasteners 18.

First section 12 includes extension or flap 15 that is constructed to extend at least a minimum predetermined distance beyond the opposing terminal ends 9 and onto sidewall 3 of tank 2. Retention mechanism 80 interfaces with flap 15 to adjust cover 10 to accommodate the dimensional variations in the lengths of tanks 2, as required, and retain cover 10 in a taught position along the length of front portion 7.

Panel 52 has second edge 43 that is opposed to first edge 56 and opposing third and fourth side edges 57 that connect to edges 56 and 43. Panel 54 has second edge 43 that is opposed to first edge 56 and opposing third and fourth side edges 58 that connect to edges 56 and 43. Panels 52 and 54 are preferably oversized and dimensionally larger than end walls 9 such that at least a portion of panels 52 and 54 in proximity to edges 56, 57 and 58 can extend onto sidewall 3.

Figure 7:
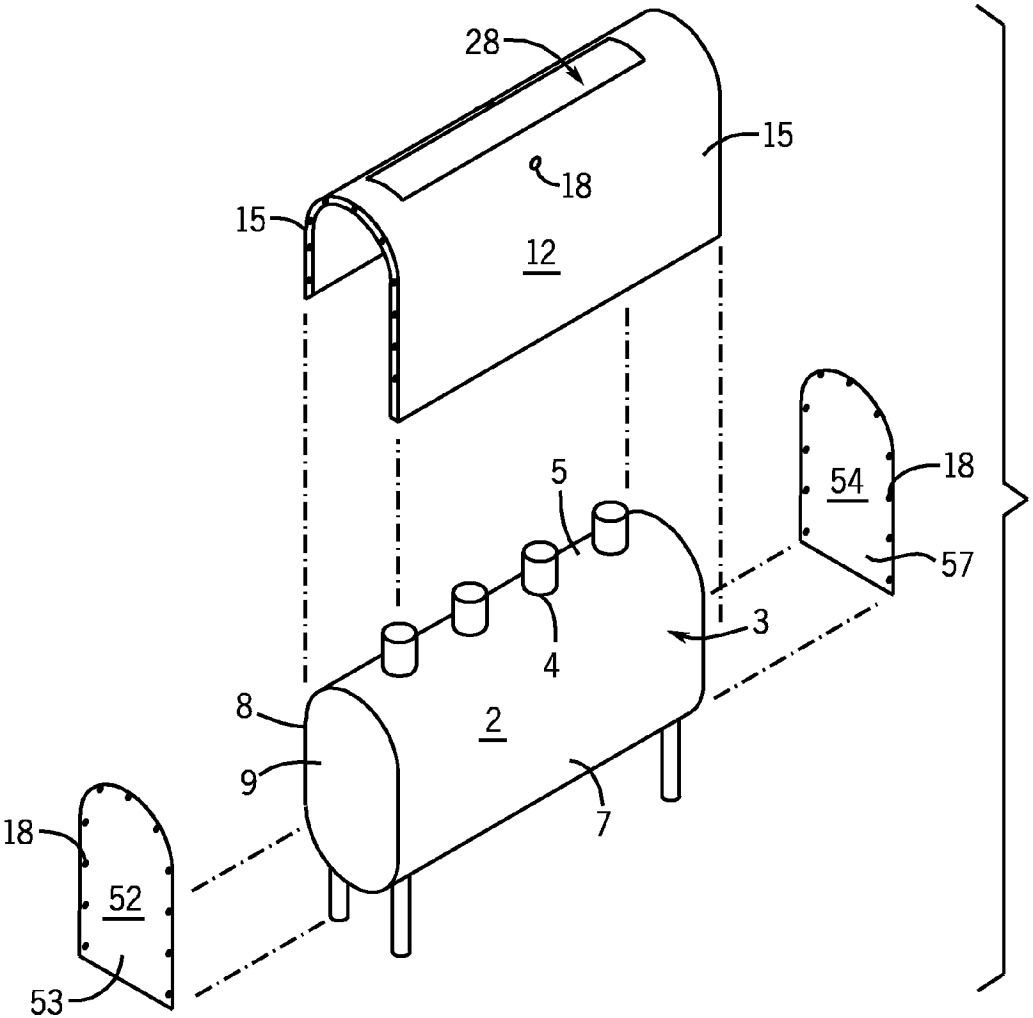
FIG. 7 is the front, side and top perspective view of FIG. 5 that shows the placement of the universal tank overlay on the exemplary tank.
Figure 8:
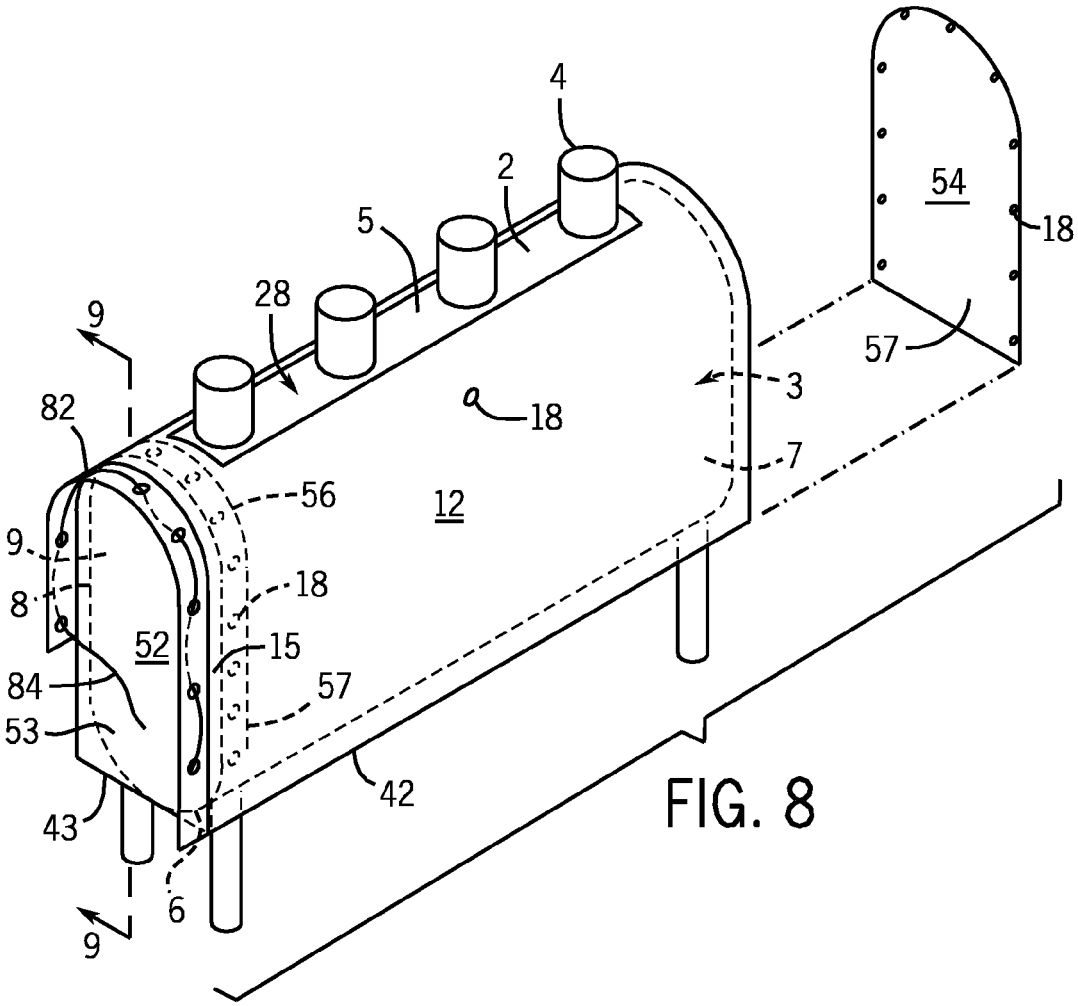
FIG. 8 is the front side and top perspective view of FIG. 5 showing the connecting of the universal tank overlay to the exemplary tank.

As shown in FIGS. 5, 7 and 8, the operational use of the second embodiment of cover 10 includes adjusting first section 12, as required, to accommodate pipes 4. Panels 52 and 54 are positioned on the terminal ends 9. In this preferred embodiment, the dimensions of panels 52 and 54 are preferably oversized relative to terminal end 9 of tank 2 such that edges 56 and 57 of panel 52 and edges 56 and 58 of panel 54 extend over and onto sidewall 3. Fasteners 18 in proximity to edges 56, 57, and 58 connect to sidewall 3 of tank 2. The attachment of panels 52 and 54 can also include the use of non-magnetic snap fasteners 18 that have mating components attached to corresponding positions on panels 52, 54 and section 12, respectively. As defined herein, the use of fasteners 18 can also include the making of one or more bonds 19 as described previously. Fasteners 18 attach layer 10 to tank 2 and fix the position of layer 10 relative to tank 2. It is understood, however, that while the magnetic connection of fasteners 18 fixes the position of layer 10 relative to tank 2, this is not a permanent attachment and that the actual position of layer 10 relative to tank 2 is limited by material constraints and the use of magnetic fasteners 18 can shift over extended periods time with the application of, for example strong wind forces.

First section 12 is positioned on sidewall 3 and, as required, around pipes 4. In this preferred embodiment, a large preformed aperture 28 is positioned in section 12. Similarly, line 30 can be a marking, a line of preformed weakness or a separation that aids in separating section 12 so that aperture 28 can be positioned around pipes 4 with external connections, for example.

First section 12 in this preferred embodiment extends across front portion 7, top portion 5 and selectively on back portion 8. Flaps 15 of first section 12 extend past terminal ends 9 of tank 2. Edge 42 of section 12 approximately aligns with edge 43 of panels 52 and/or 54. Panels 52 and 54 can be positioned before or after the placement of section 12. First section 12 is securely positioned on tank 2 using fasteners 18 which can include retention mechanism 80.

In this one preferred embodiment of retention mechanism 80, flap 15 includes a plurality of apertures 82 that can be further reinforced by stitching and/or a grommet, for example. A cord 84 is connected to one aperture 82 at the beginning of the arc of the top of tank 2 and drawn through apertures 82 to terminate at the opposing end or the arc of the top of tank 2. Cord 84 is then pulled tight to place apertures 82 and flap 15 under tension.

A second set of cords 84 connect to opposing apertures 82 in flap 15 directly across panels 52 and 54. Second cords 84 preferably connect to the lowest aperture 82 on the backside of flap 15 and one of the lowest apertures 82 in flap 15 on the front side of tank 2. This diagonal positioning of cords 84 assists in keeping cover 10 taught across tank 2. Cords 84 can be a standard rope made of natural materials such as cotton as well as polymers, composite materials or blends thereof, but cords 84 preferably include a bias element that assists in keeping the opposing sides of first section 12 on the front and back sides of tank 2 under tension so as to provide a smooth laying first section 12 and/or retain first section 12 on tank 2.

Retention mechanism 80 provides a taught connection between cover 10 on tank 2 and/or assists in the retention of cover 10 on tank 2. In this regard, the specific devices of retention mechanism can vary. For example, it is understood that the tensile forces applied by the arrangement of apertures 82 and cords 84 in proximity to the end walls 9 of tank 2 can also be applied by a variety of devices that include, for example, a bias element being integrated into or through flap 15 that urges a reduction in the diameter of the external edges of flap around tank 2. Similarly, a flexible tube connected to flap 15 with adjustably connecting end portions, such as telescoping for example, that adjust the diameter of the tube and flap 15 to provide the desired application of tension to cover 10 on tank 2.

Retention mechanism 80 preferably functions to retain cover 10 in position on tank 2 and/or provide a pleasant taught appearance to cover 10. Similarly, cord 84 that extends across panels 52 and 54 has equivalents such as a pair of rods adjustably connected by a turnbuckle that can place cover 10 in tension around tank 2. Further, the placement of retention mechanism 80 can be a connector between edges 42 and 62 when layer 10 extends around sidewall 3 (see FIG. 6) or one or more connectors that attach to the supports for tank 2 in proximity to bottom portion 6 of sidewall 3. These and other common equivalents are encompassed by retention mechanism 80.

In many instances the limited working area between end wall 9 and/or back portion 8 is the region of inches and precludes access. In these instances the ability to use one of panels 52, 54 can be precluded and/or the portion of first section 12 that extends onto back portion 8. Retention mechanism 80 provides the ability to have a preformed or adjustable fastener 18 that is biased to a closed or secure position that can be temporarily expanded to slide over one end wall 9 of tank 2 that is in close proximity to the external structure and then over the opposing end wall 9. Retention mechanism 80 provides the ability to securely position cover 10 on tank 2 under a bias that at least keeps first section 12 taught across the front portion 7 of sidewall 3. As desired, the taught secure positioning of cover 10 can further include extensions that connect between edges 42 and 62 for example under bottom portion 6 and/or between edges 42 and 62 and the support posts of tank 2. This additional structure can also provide additional uplift protection for cover 10.

Figure 9:
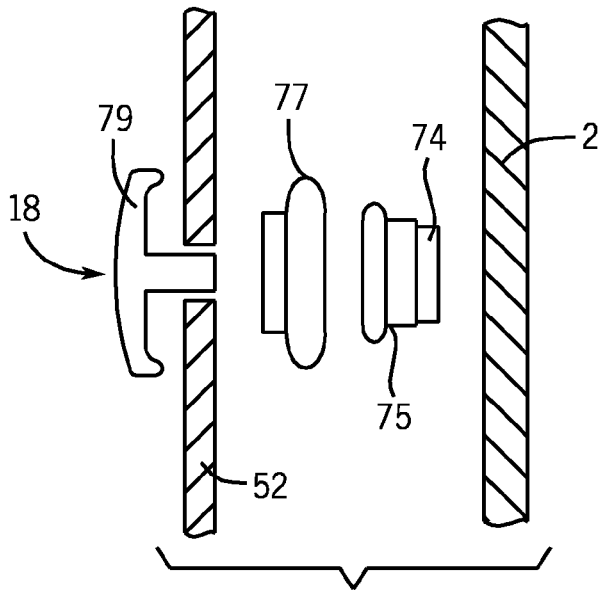
FIG. 9 is a cross-sectional view of one of the fasteners of the set of fasteners taken along lines 9-9 of FIG. 8.

Referring now to FIG. 9, the preferred embodiment select fasteners 18 include a first portion and a second portion. The first portion includes a magnet 74 that connects to a stud 75. The opposing or second portion of fastener 18 includes a snap socket 77 and a snap cap 79. Snap socket sockets 77 removably connect to studs 75. Caps 79 and snap sockets 77 connect together through opposing sides of cover 10 and are preferably crimped together. Socket 77 is positioned on the inner side of cover 10 to matingly interface with studs 75. This arrangement advantageously fixes the second portion of fastener 18 at a desired position on cover 10. The first portion connects to and securely fastens cover 10 to tank 2 preferably using high strength magnets 74 as described previously. In addition, fastener 18 can be used to connect sections of cover 10 together with or without magnet 74 by the connecting of stud 75 to a first section of cover 10 and snap socket 77 and snap cap 79 to a second section of cover 10. As discussed previously, fasteners 18 can also be employed to secure panels 32 to tank 2 and/or one or more sections of cover 10.

Cover 10 can be made of a wide variety of materials to include natural and man made fibers, but is preferably made of a vinyl material that is intended for indoor or outdoor use. The flexible vinyl sheet in one preferred embodiment has a weight of four (4) ounces/yard. In another preferred embodiment, cover 10 is fabricated from a vinyl coated polyester material. Cover 10 can also be fabricated of a stretchable material that can further aid in the creation of smooth surfaces on tank 2. Similarly, while cover 10 is shown as having edges 42 and 43 hanging freely from tank 2, cover 10 can be conforming to the overall approximate shape of tank 2 using fasteners 18 and/or materials such as a shrink wrap. Cover 10 can also include fire resistant or nonflammable materials.

In the preceding specification, the present disclosure has been described with reference to specific exemplary embodiments thereof. It will be evident, however, that various modifications, combinations and changes may be made thereto without departing from the broader spirit and scope of the invention as set forth in the claims that follow. For example, while the universal tank overlay 10 is described herein as adapted for use with a home oil heating tank 2, it is understood that the universal tank overlay 10 can be adjusted to connect to other tanks such as those for natural gas, compressed nitrogen, etc. that are both residential or commercial. Similarly, it is understood that while the tank blanket is described in terms of an exemplary oil tank with an approximately horizontal elongate longitudinal axis, other storage tanks can have alternative elongate longitudinal axis orientations to include, vertical, for example. Similarly, while universal tank overlay 10 is described herein as having four sides and specific or approximated shapes, it is understood that the universal tank overlay can have a broad range of overall shapes, that include for example, any number of sides. In addition, though the present invention is described in terms of a series of embodiments, each embodiment of the present invention can combine one or more novel features of the other embodiments. The specification and drawings are accordingly to be regarded in an illustrative manner rather than a restrictive sense.

What is claimed is:

1. A universal tank overlay adapted for use with storage tanks, the tanks include elongate and at least partially arcuate tubular front sidewall portion that connects to two opposing terminal end walls, the sidewall portions of the tanks varying in length, a plurality of pipes connect to the tanks and extend from the tanks, the overlay comprises:

a flexible layer of material that includes at least one section, a first section of the layer has a first elongate edge, a second elongate edge opposed to the first edge, a third edge and a fourth edge opposed to the third edge, the layer adapted for positioning on the top portion, the front sidewall portion and at least partially on the back sidewall portion of the storage tank, the layer adapted to accommodate the position of the plurality of pipes on the tank and the layer adapted to adjust to the position of the tank relative to the structure, the first section includes longitudinally extending flaps along the third and fourth edges, the flaps adapted to extend a predetermined distance beyond the opposing terminal end walls of the storage tank;

at least one aperture defined in the first section of the layer, the at least one aperture adapted to receive at least one of the plurality of pipes of the tank;

a retention mechanism that is adapted to position the layer in tension, the retention mechanism includes a plurality of fasteners that are adapted to attach the layer to the tank, the flaps adapted to be positioned over the terminal end walls of the storage tank and under tension, the tension of the opposing flaps position the front sidewall portion between the flaps in tension, the retention mechanism places the flaps under tension adapted to retain the first section on the storage tank, the fasteners adapted to fix the position of the layer relative to the tank.

2. The universal tank overlay of claim 1, wherein the layer includes a decorative element.

3. The universal tank overlay of claim 1, wherein the layer includes fasteners and at least one of the fasteners includes a magnet, the magnet adapted to connect the layer to the tank, the sidewall portions and terminal end walls of the storage tank include ferrous metal.

4. The universal tank overlay of claim 3, wherein the fasteners include a snap cap, a snap socket and a snap stud, the snap cap and snap socket connect to the layer, the snap socket connects to the snap stud and the snap stud connects to a magnet, the magnet adapted to magnetically attach the layer to ferrous metal portions of the storage tank.

5. The universal tank overlay of claim 1, wherein the layer includes fasteners and the fasteners connect portions of the layer.

6. The universal tank overlay of claim 1, wherein the layer and retention mechanism are adapted to adjust to the position of the tank relative to an external adjoining structure that makes at least part of the back sidewall portion of the storage tank inaccessible, the first section adapted to be positioned at least partially on the back sidewall portion of the storage tank and the retention mechanism places the first section in tension between the flaps with the layer adapted to be at least partially on the back sidewall portion of the storage tank.

7. The universal tank overlay of claim 1 that further includes at least one panel, each panel adapted to be positioned on one of the terminal end walls of the storage tank, the at least one panel and the first section adapted to be adjustably positioned in overlapping relation on the storage tank.

8. The universal tank overlay of claim 7, wherein the at least one panel is dimensioned to be at least partially oversized relative to the terminal end walls of the storage tank, the at least one panel adapted for at least partially positioning on the front sidewall portion, the back sidewall portion and the top portion of the storage tank.

9. The universal tank overlay of claim 1, wherein the first section is adapted to be held in position on the storage tank solely through the use of the retention mechanism.

10. The universal tank overlay of claim 1, wherein the retention mechanism is adapted to retain the first section on the storage tank without fasteners that connect the first section to the storage tank.

11. The universal tank overlay of claim 10, wherein the cord includes the use of the at least one cord to connect opposing apertures in the flap.

12. The universal tank overlay of claim 1, wherein the retention mechanism includes apertures in the flaps and at least one cord, the cord is run through the apertures and pulled taught to place the flaps in tension.

13. The universal tank overlay of claim 1, wherein the flaps include a bias element and the bias element places the flaps in tension.

14. A universal tank overlay adapted for use with storage tanks, the tanks include elongate and at least partially arcuate tubular front and back sidewall portions that connect to two opposing terminal end walls, the sidewall portions of the tanks varying in length, a plurality of pipes connect to the tanks and extend from the tanks, the overlay comprises:

a flexible layer of material that includes a first section and at least one panel, the first section of the layer has a first elongate edge, a second elongate edge opposed to the first edge, a third edge and a fourth edge opposed to the third edge, the layer adapted for positioning on the top portion, the front sidewall portion and at least partially on the back portion of the storage tank, the layer adapted to accommodate the position of the plurality of pipes on the tank and the layer adapted to adjust to the varying dimensions of the storage tank, the elongate edges, third edge and fourth edge of the first section adapted to extend a predetermined distance beyond the opposing terminal end walls of the storage tank, the first section and at least one panel adapted to accommodate variations in the length of the storage tanks;

at least one aperture defined in the first section of the layer, the at least one aperture adapted to receive at least one of the plurality of pipes of the tank;

a retention mechanism adapted to position and retain the layer in position on the storage tank, the first section adapted to be positioned on the terminal end walls of the storage tank and each panel of the at least one panel adapted to be positioned on one of the terminal end walls of the storage tank, the opposing third edge and fourth edge of the first section adapted to be positioned in a taught position on the terminal ends of the storage tank, the retention mechanism positions the front sidewall portion of the first section in tension between the taught positions on the terminal ends; and at least one fastener connected to the layer in proximity to the third edge and the fourth edge of the first section, the at least one fastener positions the first section of the layer in tension.

15. The universal tank overlay of claim 14, wherein the layer includes a decorative element.

16. The universal tank overlay of claim 14, wherein the layer includes fasteners and at least one of the fasteners includes a magnet, the sidewall portions and terminal end walls of the tank include ferrous metal, the magnet of the fasteners adapted to connect the to the tank.

17. The universal tank overlay of claim 14, wherein the first section and at least one panel are an integral assembly, the panels detachable from the first section.

18. The universal tank overlay of claim 14, wherein the at least one panel is at least partially oversized relative to the terminal end wall of the storage tank, each panel adapted to be positioned at least partially on the top portion and sidewall portions of the storage tank, the first section and the at least one panel positioned in overlapping relation.

19. The universal tank overlay of claim 14, wherein the first section adapted to adjust to the position of the tank relative to an external adjoining structure that makes at least part of the back sidewall portion of the storage tank inaccessible to the layer, the first section adapted to be positioned at least partially on the back sidewall portion of the storage tank, the retention mechanism places the first section in tension between the third edge and fourth with the first section adapted to be at least partially on the back sidewall portion of the storage tank.

20. The universal tank overlay of claim 14, wherein the first section adapted to adjust to the varying dimensions of the storage tanks, the third edge and fourth edge dimensioned and adapted to extend a predetermined distance beyond the terminal end walls of the storage tank, the predetermined distance between the third edge and fourth edge accommodates the varying dimensions of the storage tanks and places the first section in tension between third edge and fourth edge, the retention mechanism places the first section in tension between the third edge and fourth edge.

* * * * *